US009251642B2

(12) United States Patent
He et al.

(10) Patent No.: US 9,251,642 B2
(45) Date of Patent: Feb. 2, 2016

(54) SYSTEM AND METHOD OF MANAGING CASINO PATRON MONEY BALANCES

(75) Inventors: Chao He, Broughty Ferry (GB); Andrew Colley, Dundee (GB)

(73) Assignee: NCR Corporation, Duluth, GA (US)

( * ) Notice: Subject to any disclaimer, the term of this patent is extended or adjusted under 35 U.S.C. 154(b) by 1545 days.

(21) Appl. No.: 12/607,579

(22) Filed: Oct. 28, 2009

(65) Prior Publication Data

US 2011/0098106 A1 Apr. 28, 2011

(51) Int. Cl.
*A63F 9/24* (2006.01)
*G07F 17/32* (2006.01)

(52) U.S. Cl.
CPC ..... *G07F 17/32* (2013.01); *G07F 17/3223* (2013.01); *G07F 17/3244* (2013.01); *G07F 17/3255* (2013.01)

(58) Field of Classification Search
CPC . G07F 17/32; G07F 17/3244; G07F 17/3251; G07F 7/025
USPC ..... 463/25, 39, 42
See application file for complete search history.

(56) References Cited

U.S. PATENT DOCUMENTS

| | | | | |
|---|---|---|---|---|
| 2002/0034299 | A1* | 3/2002 | Charrin | 380/251 |
| 2003/0162593 | A1* | 8/2003 | Griswold | 463/39 |
| 2004/0147309 | A1* | 7/2004 | Chamberlain et al. | 463/25 |
| 2004/0204233 | A1* | 10/2004 | Saffari et al. | 463/25 |
| 2005/0020354 | A1* | 1/2005 | Nguyen et al. | 463/25 |
| 2006/0073883 | A1* | 4/2006 | Franks | 463/25 |
| 2007/0060310 | A1* | 3/2007 | Juds et al. | 463/25 |
| 2007/0066398 | A1* | 3/2007 | Rowan | 463/42 |
| 2007/0278294 | A1* | 12/2007 | Page | 235/380 |
| 2008/0207307 | A1* | 8/2008 | Cunningham II et al. | 463/25 |

* cited by examiner

*Primary Examiner* — Steve Rowland
(74) *Attorney, Agent, or Firm* — Paul W. Martin; Schwegman, Lundberg, Woessner

(57) ABSTRACT

A system and method of managing casino patron money balances which stores patron money balances in electronic form. The system includes an interrogator, and a self-service computer coupled to the interrogator for interrogating a wireless communicator associated with a casino patron to determine a money balance associated with the wireless communicator and for processing a selection by the casino patron to produce a change in the money balance.

22 Claims, 3 Drawing Sheets

SYSTEM AND METHOD OF MANAGING CASINO PATRON MONEY BALANCES

BACKGROUND

In casinos, game players use paper tickets to carry money balances from one game to the next. Ticket values can be redeemed either at assisted-service counters or through self-service computer systems called Ticket-In-Ticket-Out (TITO) machines.

However, the drawbacks of using paper tickets are that players may very easily lose tickets, tickets can become destroyed or damaged, casinos incur cost from replenishing tickets, and casinos incur cost for maintaining ticket printers.

Therefore, it would be desirable to provide a system and method of managing casino patron money balances without the disadvantages of tickets.

SUMMARY

A system and method of managing casino patron money balances is provided.

The system includes an interrogator, and a self-service computer coupled to the interrogator for interrogating a wireless communicator associated with a casino patron to determine a money balance associated with the wireless communicator and for processing a selection by the casino patron to produce a change in the money balance.

DETAILED DESCRIPTION

Figure 1:
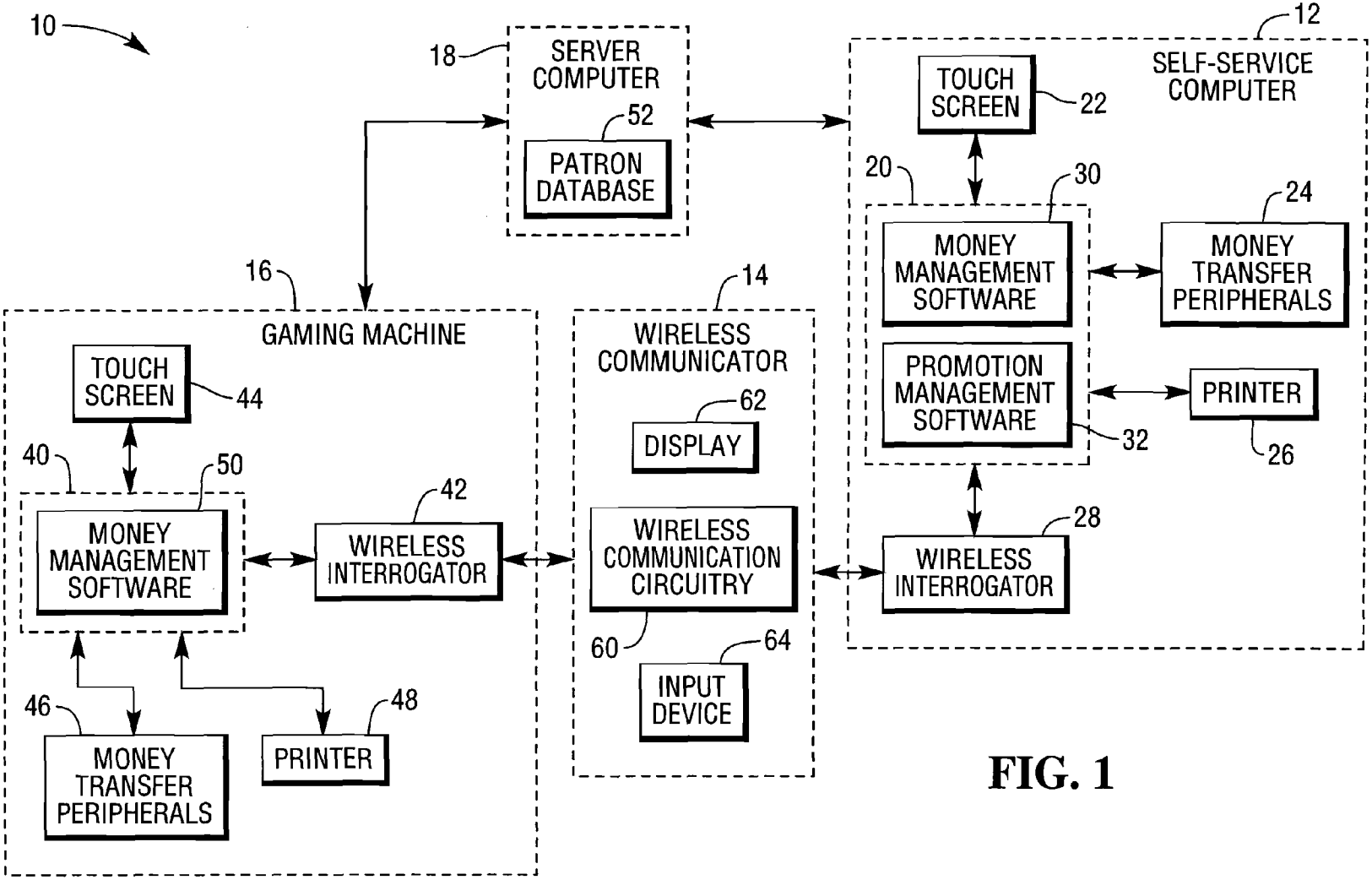
FIG. 1 illustrates a block diagram of an example casino system.

Referring now to FIG. 1, an example casino system 10 includes self-service computer 12, wireless communicator 14, and gaming machine 16.

Self-service computer 12 includes processor 20, which executes money management software 30. Money management software 30 performs money transactions on behalf of casino patrons, including cash transfer transactions prior to playing games and cash redemption transactions when patrons are finished playing games.

For example, a casino patron may increase the money balance by depositing tangible cash money in exchange for an increase in the money balance or by transferring money value from a bank account of the casino patron in exchange for the increase in the money balance. Conversely, the casino patron may decrease the money balance by withdrawing tangible cash money in exchange for a decrease in the money balance or by transferring money value to a bank account of the casino patron in exchange for the decrease in the money balance.

Additional services provided by money management software 30 may include electronic money transfers to and from patron bank accounts, cash withdrawal, cash deposit, and other banking transactions.

Processor 20 may additionally execute promotion management software 32 identifies and provides promotions to patrons.

Processor 20 may execute additional software directed to the location and purpose of self-service computer 12. For example, processor 20 may execute software for making purchases of goods and services, for reserving a room, or for making travel arrangements and printing boarding passes.

Processor 20 may execute an operating system such as a Microsoft operating system, which can display screen information within one or more windows.

Self-service computer 12 additionally includes memory, program and data storage, a display, and a user input device. The display and user input device may be combined as a touch screen 22. An example embodiment of self-service computer 12 may include a kiosk.

Self-service computer 12 further includes wireless interrogator 28, which communicates with wireless communicator 14. Wireless interrogator 28 periodically transmits polling signals to determine whether wireless communicator 14 is within range. When wireless communicator 14 is within range, wireless interrogator 28 may obtain money balance and promotion information from wireless communicator 14 and/or sufficient information to identify the patron associated with wireless communicator 14. Once a patron is identified and begins use of self-service computer 12, wireless interrogator 42 may interrogate other wireless communicators 14 that may come within range but ignore them. Money management software 30 updates the patron's money balance information, either within wireless communicator 14 or within patron database 52.

Self-service computer 12 additionally includes components and peripherals necessary to accomplish the purpose for the environment in which it is located. For example, self-service computer 12 may additionally include, but not be limited to, one or more money transfer peripherals 24 and a receipt printer 26 and/or other printer. Example money transfer peripherals include a card reader for reading debit and credit cards, a currency and/or coin accepter, a currency and/or coin dispenser, and biometric reader for patron identification purposes. The card reader may also function to read patron loyalty cards.

Self-service computer 12 may be equipped with security features to ensure that lost or stolen wireless communicators 14 cannot be used to obtain the money value associated therewith. For example, a patron may be required to pre-register with a personal identification number (PIN) or biometric signature stored within wireless communicator 14 or at server computer 18. Self-service computer 12 compares entered PINs or biometric signatures with stored reference PINs or biometric signatures.

Self-service computer 12 may also offer and deliver special promotions, coupons, and the like to patrons as they redeem their money balances. Wireless communicator 14 may include an introductory amount or other promotional amount upon delivery to the patron.

Wireless communicator 14 acts as a token representing money value. Wireless communicator 14 may be owned by a patron. The patron may pre-register. Pre-registration may be part of a casino loyalty program.

Alternatively, wireless communicator 14 may be owned by the casino. The patron receives wireless communicator 14 when entering the casino and turns in wireless communicator 14 when leaving the casino. An example wireless communicator 14 may include a bracelet or other portable or hand-held device.

Self-service computer 12 may include a dispenser for dispensing wireless communicators 14 and a bin for accepting returns. Alternatively, the casino may choose to manage dispensing and return of wireless communicators 14 separately from self-service computer 12.

One example wireless communicator 14 includes a radio frequency identification (RFID) tag. Another example wireless communicator 14 includes a near field communication (NFC) device, such as a mobile phone or other portable device equipped with NFC circuitry.

In one embodiment, wireless communicator 14 may store a balance of money value. Wireless interrogator 28 obtains the balance from wireless communicator 14 under the control of money management software 30. Wireless communicator 14 may also store promotions.

In another embodiment, wireless communicator 14 stores an identifier which is associated with a patron and a money balance in patron database 52. Wireless interrogator 28 obtains the identifier from wireless communicator 14 under the control of money management software 30 and then money management software 30 obtains the corresponding money balance from patron database 52. Under this embodiment, patron database 52 may also store promotions associated with the patron.

The latter embodiment has the advantage that if a patron ever loses wireless communicator 14 or if wireless communicator 14 is ever lost or stolen, the patron's money balance and promotions, if any, are not lost or stolen as well.

Self-service computer 12 may store patron database 52 or access patron database 52 from server computer 18 via a network connecting self-service computer 12 and server computer 18.

Wireless communicator 14 may be limited to a communication device with communication circuitry 60, or include additional components that facilitate patron interaction. For example, wireless communicator 14 may include a display 62 for viewing a money balance, and an input device 64, such as a keypad or fingerprint sensor for securing use of wireless communicator 14.

Gaming machine 16 includes processor 40, which executes gaming software 50. Gaming software 50 controls operation of gaming machine 16, including managing exchanges of money value between wireless communicator 14 and gaming machine 16.

Gaming machine 16 additionally includes memory, program and data storage, a display, and a user input device. The display and user input device may be combined as a touch screen 44. An example gaming machine 16 may include a computerized slot machine.

The operation of gaming machine 16 is similar in many ways to the operation of self-service computer 12. Gaming machine 16 is a type of self-service computer. Gaming machine 16 includes wireless interrogator 42, which communicates with wireless communicator 14. Wireless interrogator 42 periodically transmits polling signals to determine whether wireless communicator 14 is within range. When wireless communicator 14 is within range, wireless interrogator 42 may obtain money balance and promotion information from wireless communicator 14 and/or sufficient information to identify the patron associated with wireless communicator 14. Once a patron is identified and begins playing a game at gaming machine 16, wireless interrogator 42 may interrogate other wireless communicators 14 that may come within range but ignore them.

Gaming machine 16 additionally includes components and peripherals necessary to accomplish its purpose. For example, gaming machine 16 may additionally include, but not be limited to, one or more money transfer peripherals 46 and receipt printer 48. Example money transfer peripherals 46 include a card reader for reading debit and credit cards, a currency and/or coin accepter, a currency and/or coin dispenser, and biometric reader for patron identification purposes. The card reader may also function to read patron loyalty cards.

Gaming machine 16 may be equipped with security features to ensure that lost or stolen wireless communicators 14 cannot be used to obtain the money value associated therewith. Gaming machine 16 compares entered PINs or biometric signatures with stored reference PINs or biometric signatures.

The patron may choose to insert tangible cash money, i.e., money in tangible form as currency or coins, or play from the money balance stored within wireless communicator 14 or within patron database 52, or a combination of both. Gaming machine 16 updates the patron's money balance to reflect and payments made, any winnings earned, or any losses suffered as the patron may direct.

For example, a patron may begin play at gaming machine 16 by inserting tangible cash money or by bringing wireless communicator 14 within range of wireless interrogator 42. Inserting tangible cash money overrides prompts to play from the patron's money balance associated with wireless communicator 14. Otherwise, gaming machine 16 interrogates wireless communicator 14 and determines whether the patron's money balance is sufficient to begin a next round of play. If the money balance is large enough, gaming machine 16 displays a prompt asking the patron to enter identification information.

Following a win, gaming machine 16 displays a prompt asking the patron whether the patron wishes to collect winnings as tangible cash money or as an increase in the patron's money balance. Following a loss, gaming machine 16 reduces the money balance if the patron elected to play from the money balance.

Wireless communicator 14 may have additional functions. For example, wireless communicator 14 may be a substitute for a loyalty card. Wireless communicator 14 may enroll a patron in a loyalty program or communicate loyalty program status to affiliated casinos, lodging establishments, restaurants, entertainment providers, stores, and other places of business.

Wireless communicator 14 may also serve as a digital or electronic, "e-wallet". Wireless communicator 14 may communicate with wireless interrogators in affiliated casinos, hotels, restaurants, stores, and other places of business in order to pay for patron purchases.

Figure 2:
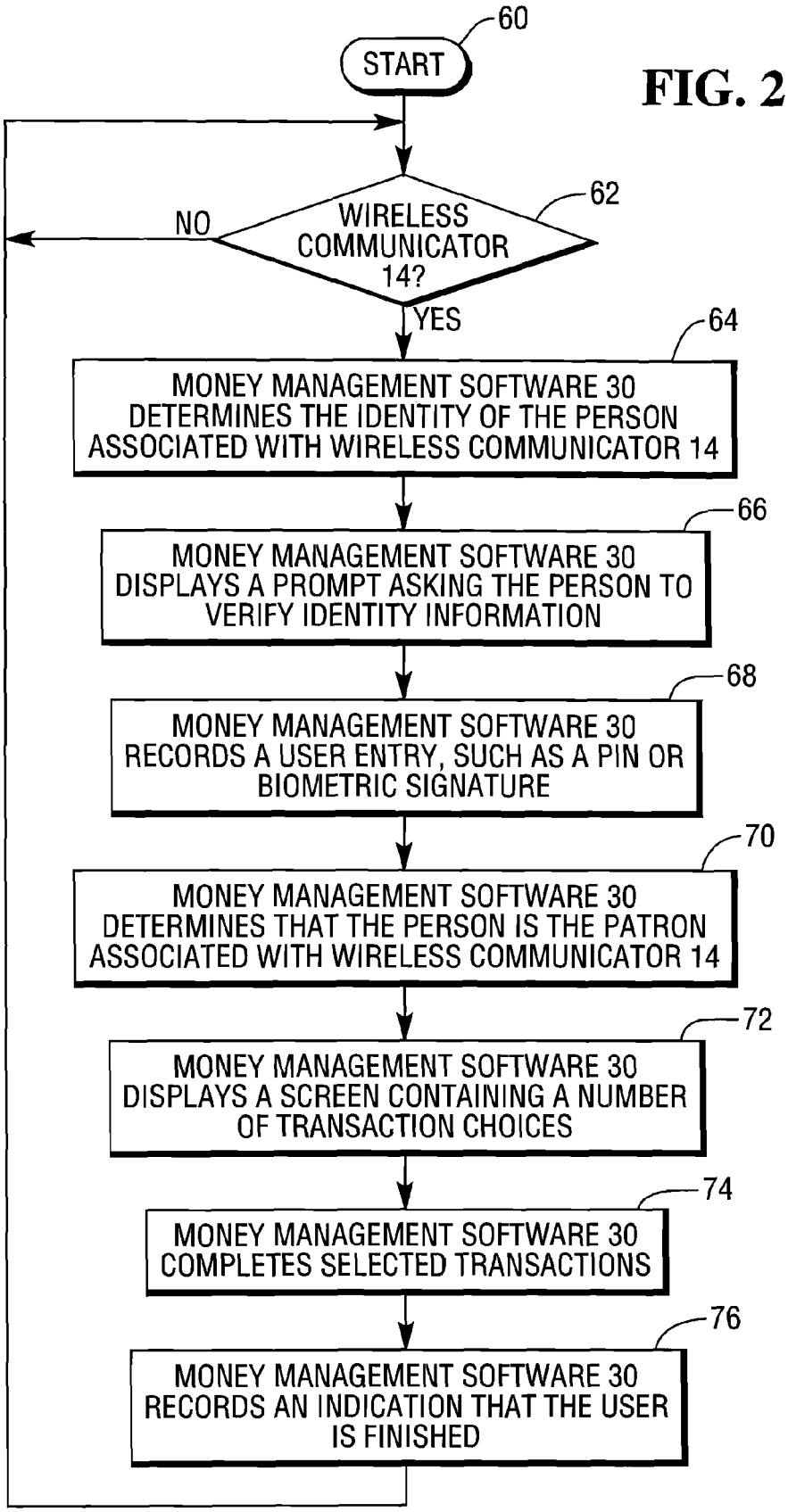
FIG. 2 illustrates an example method of operation of a self-service computer.

Referring now to FIG. 2, an example method of operation of money management software 30 is illustrated beginning with START 60.

In step 62, money management software 30 waits for a person with wireless communicator 14 to come within range of wireless interrogator 28. Operation continues to step 64 if money management software 30 detects wireless communicator 14.

In step 64, money management software 30 determines the identity of the person associated with wireless communicator 14.

In step 66, money management software 30 displays a prompt asking the person to verify identity information.

In step 68, money management software 30 records a user entry, such as a PIN or biometric signature.

In step 70, money management software 30 compares the user entry to reference information on file for the patron associated with wireless communicator 14 and determines based upon a match that the person is the patron.

In step 72, money management software 30 displays a screen containing a number of transaction choices, including choices directed to adding money value to the money balance associated with wireless communicator 14, and/or converting all or some of the money balance associated with wireless communicator 14 to tangible cash money, e.g., currency and/or coins. Money management software 30 may offer additional choices, including electronic money transfers to and from patron bank accounts, cash withdrawal, cash deposit, and other banking transactions.

In step 74, money management software 30 records user selection of one or more transactions, completes the transactions, and prints a receipt, if requested by the user.

In step 76, money management software 30 records an indication that the user is finished and returns to step 62 to wait for another user.

Figure 3:
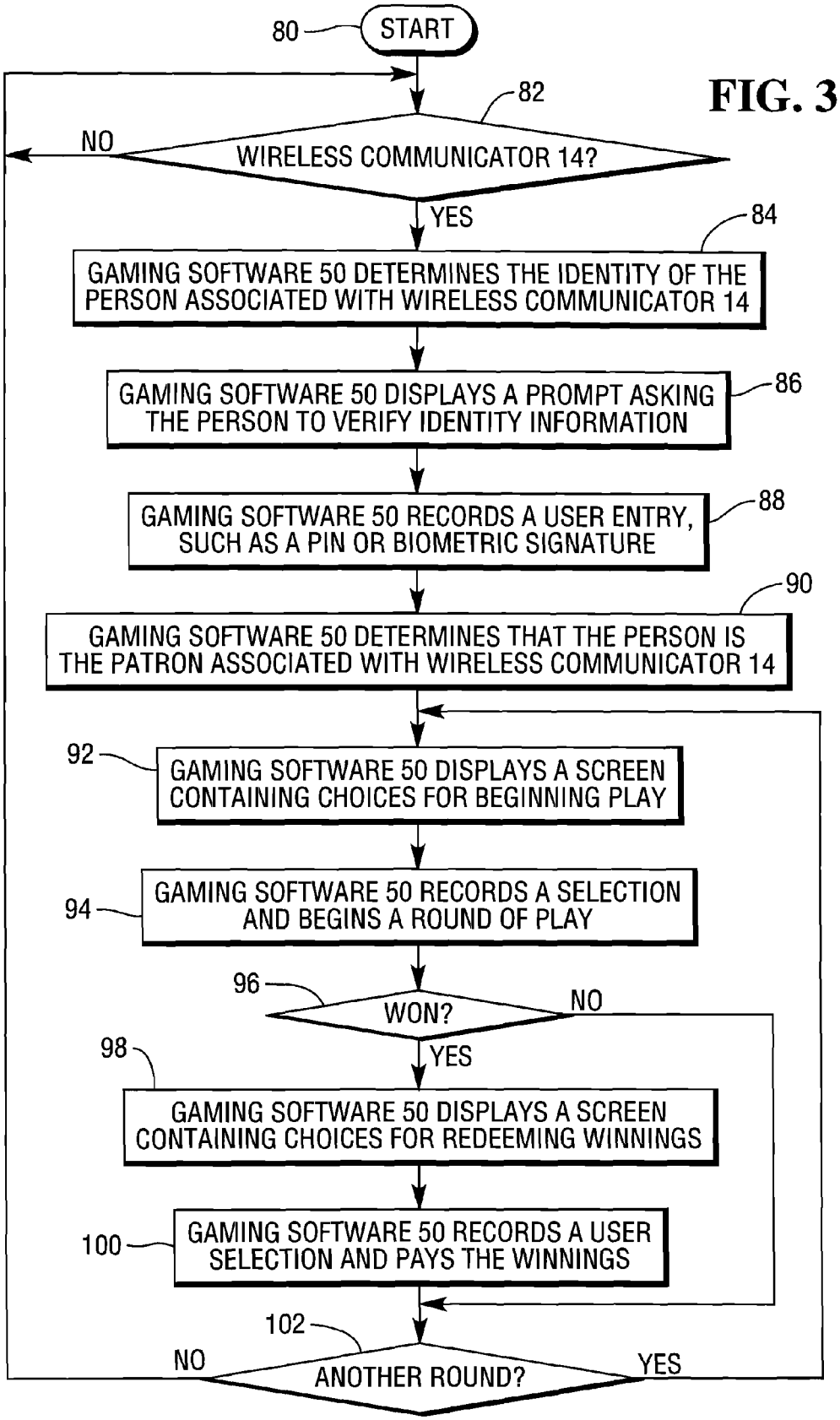
FIG. 3 illustrates an example method of operation of a gaming machine.

Referring now to FIG. 3, an example method of operation of gaming software 50 is illustrated beginning with START 80.

In step 82, gaming software 50 waits for a person with wireless communicator 14 to come within range of wireless interrogator 42. Operation continues to step 84 if gaming software 50 detects wireless communicator 14.

In step 84, gaming software 50 determines the identity of the person associated with wireless communicator 14.

In step 86, gaming software 50 displays a prompt asking the person to verify identity information.

In step 88, gaming software 50 records a user entry, such as a PIN or biometric signature.

In step 90, gaming software 50 compares the user entry to reference information on file for the patron associated with wireless communicator 14 and determines based upon a match that the person is the patron.

In step 92, gaming software 50 displays a screen containing choices for beginning play, including inserting tangible cash money and applying some of the money value associated with wireless communicator 14.

In step 94, gaming software 50 records a user selection and begins a round of play.

In step 96, gaming software 50 finishes the round of play. If the user has won, operation continues to step 98. Otherwise, operation continues at step 102.

In step 98, gaming software 50 displays a screen containing choices for redeeming winnings, including receiving some or all of the winnings as tangible cash money and applying some or all of the winnings to the money value associated with wireless communicator 14.

In step 100, gaming software 50 records a user selection and pays the winnings. If the user elected to receive some or all tangible cash money, gaming software 50 causes gaming machine 16 to dispense tangible cash money. If the user elected to apply some or all of the winnings to the money balance, gaming software 50 adds money value to the money balance.

In step 102, gaming software 50 displays a prompt asking the user if the user wishes to play another round. If so, operation returns to step 92. Otherwise, gaming software 50 logs the user out and returns to step 82.

Although particular reference has been made to certain embodiments, variations and modifications are also envisioned within the spirit and scope of the following claims.

What is claimed is:

1. A system of managing casino patron money balances comprising:

a wireless interrogator for interrogating a wireless communicator associated with a casino patron at a distance; and a self-service computer coupled to the wireless interrogator which interrogates the wireless communicator, within range of the wireless interrogator, to determine a money balance associated with the wireless communicator and for processing a selection by the casino patron to produce a change in the money balance.

2. The system of claim 1, wherein the change comprises an increase or a decrease in the money balance.

3. The system of claim 1, wherein the wireless interrogator periodically transmits polling signals to determine whether the wireless communicator is within range.

4. The system of claim 1, wherein the change comprises an exchange of money value with a bank account of the casino patron.

5. The system of claim 1, wherein the change comprises an exchange of money value and tangible cash money.

6. The system of claim 1, wherein the change comprises a payment for gambling.

7. The system of claim 1, wherein the change comprises a payment for lodging services.

8. The system of claim 1, wherein the change comprises a payment for restaurant services.

9. The system of claim 1, wherein the change comprises a coupon.

10. The system of claim 1, wherein the self-service computer determines the money balance from the wireless communicator and changes the money balance within the wireless communicator.

11. The system of claim 1, wherein the self-service computer determines the money balance from a server computer which stores a record associated with the wireless communicator containing the money balance, and changes the money balance within the record.

12. The system of claim 1, wherein the self-service computer is also for associating special promotions with the wireless communicator.

13. The system of claim 1, wherein the self-service computer further comprises a touch screen combining a user input and a display wherein the user input is employed to input the selection by the casino patron.

14. The system of claim 1, wherein the self-service computer comprises a gaming machine.

15. A system of managing casino patron money balances comprising:

a money transfer peripheral comprising a tangible money cash dispenser;

a display;

an input device;

a wireless interrogator; and a self-service computer employing the wireless interrogator to interrogate a portable wireless communicator, within range of the wireless interrogator, associated with a casino patron using the wireless interrogator, for determining first security information associated with the portable wireless communicator, for displaying a prompt to the casino patron on the display to enter second security information, for obtaining the second security information entered by the casino patron using the input device, for determining that the second security information matches the first security information, for determining a money balance associated with the portable wireless communicator, for processing a transaction including a selection by the casino patron to decrease the money balance following a gambling session by at least one of adding money value to a bank account of the casino patron and dispensing tangible cash money to the casino patron using the tangible cash money dispenser, and for ignoring other portable wireless communicators of other casino patrons during the transaction.

16. The system of claim 15 comprising a further money transfer peripheral comprising a biometric sensor.

17. A method of system of managing casino patron money balances comprising:

wirelessly interrogating a wireless communicator associated with a casino patron by a computer employing a wireless interrogator;

determining a money balance associated with the wireless communicator by the computer;

processing a transaction including a selection by the casino patron to change the money balance by the computer; and ignoring other portable wireless communicators of other casino patrons during the transaction by the computer.

18. The method of claim 17, wherein the computer comprises a gaming machine and the transaction is one of paying for a gambling session and receiving winnings from the gambling session.

19. The method of claim 17, wherein the transaction is one of adding a first money value to the money balance and subtracting a second money value from the money balance.

20. The method of claim 17, wherein the processing step comprises processing the transaction prior to a gambling session and the selection comprises increasing the money balance by at least one of adding money value from a bank account of the casino patron and accepting an amount of tangible cash money from the casino patron using a tangible cash money acceptor.

21. The method of claim 20, further comprising:

processing another transaction following the gambling session including another selection by the casino patron to decrease the money balance by at least one of adding money value to the bank account of the casino patron and dispensing another amount of tangible cash money to the casino patron using a tangible cash money dispenser by the computer.

22. The method of claim 17, further comprising:

determining first security information associated with the portable wireless communicator by the computer;

displaying a prompt to the casino patron to enter second security information by the computer;

recording the second security information entered by the casino patron by the computer; and determining that the second security information matches the first security information before the processing step.

* * * * *